United States Patent [19]

Nishihara et al.

[11] 4,364,251

[45] Dec. 21, 1982

[54] METHOD AND APPARATUS FOR COLD-WORKING ANNULAR WORKPIECES

[75] Inventors: Masao Nishihara, Kyoto; Yoshinori Fukui; Yoshio Kitamura, both of Hyogo; Yoshiyuki Kamikawa; Haruki Azuma, both of Kobe, all of Japan

[73] Assignee: Kobe Steel, Limited, Kobe, Japan

[21] Appl. No.: 224,023

[22] Filed: Jan. 12, 1981

[30] Foreign Application Priority Data

Aug. 12, 1980 [JP] Japan ..... 55-111195

[51] Int. Cl.[3] ..... B21D 22/10

[52] U.S. Cl. ..... 72/58; 72/62

[58] Field of Search ..... 72/58, 59, 60, 61, 62, 72/272; 29/421 R

[56] References Cited

U.S. PATENT DOCUMENTS

| | | | |
|---|---|---|---|
| 2,902,962 | 9/1959 | Garvin | 72/58 X |
| 3,611,768 | 10/1971 | Odakai | 72/58 |
| 3,707,864 | 1/1973 | Pigott et al. | 72/272 |
| 3,974,675 | 8/1976 | Tominaga | 72/61 |
| 4,016,737 | 4/1977 | Gustofsson et al. | 72/60 |
| 4,292,828 | 10/1981 | Germann | 72/58 X |

*Primary Examiner*—Leon Gilden

*Attorney, Agent, or Firm*—Oblon, Fisher, Spivak, McClelland & Maier

[57] ABSTRACT

Disclosed is a method and apparatus for cold-working annular workpieces by applying thereto an internal fluid pressure to cause an enlargement of the diameter thereof through plastic deformation, in which the openings at opposite ends of an annular workpiece are closed by a pair of presser plates through packings which are radially expansible along with the annular workpiece. The contacting surface pressure of the packings and presser plates are controlled to a predetermined value by an arithmetic unit operating on detected values of a main pressure acting internally on the annular workpiece, an auxiliary pressure pressingly holding the presser plates against the respective packings and varitions in the shape of the annular workpiece undergoing the plastic deformation.

2 Claims, 11 Drawing Figures

METHOD AND APPARATUS FOR COLD-WORKING ANNULAR WORKPIECES

BACKGROUND OF THE INVENTION

FIELD OF THE INVENTION

This invention relates to a method for cold-working annular workpieces by applying thereto an internal fluid pressure which causes plastic deformation and enlargement in the dimensions thereof, and more particularly to a method and apparatus for cold-working annular workpieces aimed at uniform working in conformity with the applied inner pressure and at continuous deformation-working.

Mechanical parts which are required to be non-magnetic and to have a high strength, like non-magnetic retainer rings for large generators, have thus far been produced by cold (room temperature)—or warm (350° C.)—working a Mn/Cr-type austenite steel for work hardening. For working, the enlargement in diametric dimensions is easy due to the annular shape and has been put in practice.

In this connection, the conventional methods resort to (1) ring forging or (2) expansion by expanding dies using a combination of segments and a press-in plug. However, these methods invariably require equipment of large scale (in size and pressing power of the equipment and the jigs or tools to be used) and result in irregular mechanical properties due to non-uniform working in the circumferential and axial directions. This is apparently attributable in the case of ring forging to non-uniform deformation (flow) of material caused by frictional contact with the surface of the anvil block and in the case of the segments method to the clearances which are formed between segments at the time of expansion and the non-uniform contact of the outer and inner peripheries of the segments and the annular workpiece caused by the difference in curvature of the inner diameter of the expanded cylindrical material and the outer periphery of the segments and the inner diameter of the annular workpiece before working. Further, upon expanding the annular workpiece, although it additionally undergoes reductions in the axial direction and in its thickness, these additional changes in dimension are restricted by the frictional contact with the tool to thereby increase the residual stress in the axial and radial directions.

The retainer ring for a generator is a body which is rotated at high speed, so that a problem is encountered in that the circumferential residual stress which has a self-balancing power, tending to retain balance three-dimensionally (sum of integration=0), is necessarily increased by increases in axial and radial residual stresses, having an adverse effect on the resulting products. In view of these problems, it is preferable to resort to static working by application of an internal pressure utilizing a liquid as a pressure medium.

Methods for working the non-magnetic retainer rings of generators by liquid pressure are disclosed in French Pat. No. 1,229,861, applicant's Japanese Patent Publication No. 40-8832 and USSR Pat. No. 880,523 (Japanese Patent Publication No. 52-2502), in which the hole of the annular workpiece is closed and sealed by lids of trucated cone shape which are wedged into the openings at the axially opposite ends of the hole. This is disadvantageous for the following reasons. With regard to the equipment used, since the diametric enlargement of the workpiece is accompanied by reductions in its axial dimension, the truncated-conical lids which seal the workpiece have to be moved axially toward each other upon enlarging the workpiece diameter, by means of cylinders. Due to the necessity for cylinders which are large in size and stroke length, the application of high pressure becomes difficult from the standpoint of strength and it is necessary to provide equipment of large scale like a forging press.

Further, when working annular workpieces with small axial dimensions, it is sometimes experienced that the smaller ends of the truncated conical lids which are opposed within the annular workpiece hit against each other during the diametric enlargement of the annular workpiece, loosing the sealing function to make further operation impossible. Further operation is possible only after replacement of the lids, an operation which is troublesome.

With regard to the quality, a deleterious (local) work-hardening layer is formed on the annular workpiece due to imposition of pressure and sliding movement resulting from direct contact with the lids. This is undesirable for the products and the removal of such layers invites a drop in yield. Further, the use of the sealing lids necessarily enlarges the diameter around the marginal edges of the openings at the opposite ends of the annular workpiece by the wedging action of the lids, giving rise to the possibility of causing irregularities in mechanical and physical properties and to a possible increase of residual stress by non-uniform pressurization.

SUMMARY OF THE INVENTION

With the foregoing in view, the present invention has as its object the provision of a method for working annular workpieces, which eliminates irregularities in working as much as possible and which is capable of uniformly enlarging diameters of annular workpieces in a continuous and simplified manner.

According to the present invention, there is provided a method for cold working an annular workpiece by applying thereto an internal fluid pressure to cause diametric enlargement of the annular workpiece through plastic deformation. The method comprises forming annular grooves around marginal edges of the workpiece openings at axially opposite ends of the annular workpiece; fitting a packing of ring form in each one of the annular grooves; covering the end openings with a presser plate and holding the presser plate in slidably pressed contact with the packing during the process of diametric enlargement of the annular workpiece and packing by causing an application of an increasing internal pressure; and maintaining the contacting surface pressure of the packing and presser plate at a predetermined value by detecting and calculating values indicative of a main pressure internally acting on the annular workpiece, an auxiliary pressure pressingly holding the presser plate against the packing and variations in shape caused to the annular workpiece by the increase of the main pressure, thereby continuously working the annular workpiece by plastic deformation.

The present invention also provides an apparatus for cold working an annular workpiece by applying thereto an internal fluid pressure to cause diametric enlargement of the annular workpiece through plastic deformation. The apparatus comprises a pair of diametrally expansible packings of ring form to be fitted in annular grooves formed around the marginal edges of the workpiece openings at axially opposite ends of the annular workpiece; a pair of pressure plates covering the end openings of the annular workpiece and adapted to be held in radially slidable pressure contact with the packing; a main pressure source connected to a main pressure chamber defined in the internal cavity of the annular workpiece; a cylinder device operable or moving the presser plate axially of the annular workpiece and internally defining an auxiliary presser chamber; an auxiliary presser source connected to the auxiliary presser chamber; and an arithmetic unit connected to the main and auxiliary pressure sources and adapted to maintain the contacting surface pressure of the packing and presser plate at a predetermined value by detecting and calculating values indicative of a main pressure acting in the main pressure chamber, an auxiliary pressure acting in the auxiliary pressure chamber, and variations in shape of the annular workpiece.

BRIEF DESCRIPTION OF THE DRAWINGS

The above and other objects, features and advantages of the present invention will become apparent from the following description and the appended claims, taken in conjunction with the accompanying drawings which show by way of example a preferred embodiment of the present invention.

DESCRIPTION OF THE PREFERRED EMBODIMENTS

Figure 1:
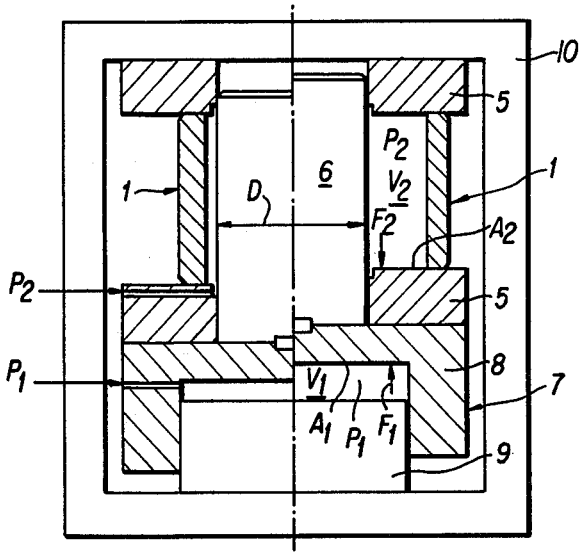
FIG. 1 is a diagrammatic sectional view illustrating the general arrangement of the cold working apparatus according to the invention, of which the left and right halves show an annular workpiece before and after the working operation, respectively.
Figure 2:
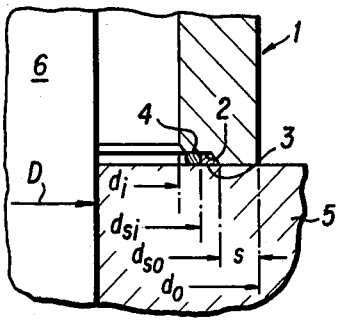
FIG. 2 is a fragmentary diagrammatic view showing on an enlarged scale a sealed end portion of the annular workpiece.

Referring to the accompanying drawings and first to FIGS. 1 and 2, indicated at 1 is a workpiece of an annular form which is formed with annular grooves 2 on its axially opposite end faces around the marginal edges of the ends of the workpiece. Each annular groove 2 receives therein a metal packing 3 of a ring form and a low pressure O-ring composed of rubber material, the packing 3 and ring 4 extending side-by-side radially in inner and outer positions, respectively. The packing 3 is provided with a sloped surface which is urged axially away from the interior of the annular workpiece 1 upon loading the inner bore of the annular workpiece 1 with an internal pressure, and forcibly pressed against the opposing surface of the workpiece so as to have a higher sealing function as the internal pressure is increased.

The annular workpiece 1, with its longitudinal axis in a vertical position, has its upper and lower openings closed by upper and lower pressure plates 5, respectively, which are slidably pressed against the packing 3 during the process of enlarging the diameter of the annular workpiece 1 by plastic deformation caused by the increase of the internal pressure. In this instance, the packing undergoes an enlargement in diameter by plastic or elastic deformation as the diameter of the annular workpiece is enlarged.

Denoted at 6 is a center shaft which is coaxial with the annular workpiece 1 and is slidably passed through the upper and lower pressure plates 5. The reference numeral 7 indicates a vertically disposed cylinder device which consists of a cylinder tube 8 and a piston 9. The lower pressure plate 5 is mounted on the upper end face of the cylinder tube 8, and the axial distance by which the piston 9 and the upper presser plate 5 are movable away from each other is restricted by a fixed frame 10. The annular workpiece 1 and the center shaft 6 define therebetween a main presser chamber $V_2$. The main presser chamber $V_2$ and an auxiliary pressure chamber $V_1$ in the cylinder tube 8 are connected to main and auxiliary pressure sources $P_2$ and $P_1$, respectively.

A pressurized fluid medium like oil, water or the like having a main pressure $P_2$ is fed to the main pressure chamber $V_2$ and, as the annular workpiece 1 and packing 3 are enlarged in diameter, the packing 3 is radially slid along the contacting surface of the presser plates 5 in conformity with the enlargement in diameter of the annular workpiece 1 by plastic deformation.

In this instance, the main pressure $P_2$ is a static pressure which acts to enlarge the diameter of the annular workpiece 1 and at the same time generates an axial force $F_2$ of a value corresponding to the main pressure $P_2$ multiplied by the sectional area $A_2$ of the main pressure chamber $V_2$. Therefore, in order to maintain the seal between the lower pressure plate 5 and the annular workpiece 1, it is necessary to generate by use the cylinder device 7 a force $F_1$ which resists the axial force $F_2$. The resistant force $F_1$ has a value corresponding to the auxiliary pressure $P_1$ as multiplied by the sectional area $A_1$ of the auxiliary chamber $V_1$. Although the enlargement in diameter of the annular workpiece 1 is accompanied by reductions in the axial dimension, as mentioned hereinbefore, the lower presser plate 5 follows the axial deformation of the annular workpiece 1 via the cylinder device 7.

FIG. 1 shows the annular workpiece 1 before and after the working operation, on the left and right sides of the center line, respectively.

Figure 3:
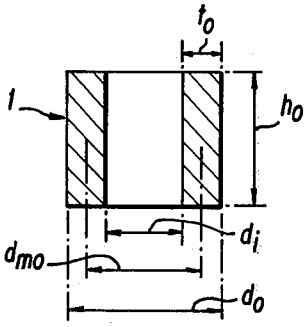
FIGS. 3 and 4 are diagrammatic longitudinal sections of the annular workpiece before and after the working operation, respectively.

Referring to FIGS. 2 and 3, the relationship between the enlargement in diameter of the annular workpiece 1, the working rate $\alpha$ and the resulting reductions in wall thickness and axial dimension are expressed as follows.

$$\alpha = \frac{\Delta d_m}{d_{mf}} = \frac{d_{mf} - d_{mo}}{d_{mi}} \quad (1)$$

$$d_{mi} = \frac{d_{mo}}{1 - \alpha} \quad (2)$$

$$t_f = t_o \cdot (1 - \alpha) \cdot (1 + \alpha/2) \quad (3)$$

$$h_f = \frac{h_o}{(1 + \alpha/2)} \quad (4)$$

wherein $$d_{mo} = \frac{d_o + d_i}{2} :$$

average diameter before working $d_o$: outer diameter before working $d_i$: inner diameter before working
$d_{mf}$: average diameter after working
$t_f$: wall thickness after working
$t_o$: wall thickness before working
$h_f$: axial dimension after working
$h_o$: axial dimension before working the respective values giving average values.

Next, the inner pressure $P_i$ (main pressure $P_2$) which is necessary for loading the annular workpiece 1 with an internal pressure for the plastic working thereof is expressed by the following equation.

$$P_i = f_{to}\left\{B_1 l_n K + \frac{B_2}{2}(K^2 - 1)\right\} \quad (5)$$

wherein
$f_{to}$: the limit of tensile elasticity (yield strength) of the annular workpiece
$B_1, B_2$: constants relative to physical properties of the annular workpiece
K: constant relative to the shape of the material $$\left(\frac{d_o}{d_i}\right)$$

The values of $F_{to}$, $B_1$ and $B_2$ depend on the mechanical or physical properties of the annular material 1 and are normally obtained by tensile tests. On the other hand, the relation between the strength of the material and the cold working rate is expressed by experimental approximate formula, and in the case of 18%Mn/5%Cr steel which is generally employed for the retainer rings of generators, is expressed by the following experimental formula $$\sigma_{0.2} = 2.4\alpha + 40 \quad (6)$$

wherein
$\sigma_{0.2}$=0.2% yield strength (kgf/mm$^2$)
$\alpha$: working rate of Formula (1)

Since experimentally in Equation (5), $f_{to}=0.8\sigma_{0.2}$, the relation between the working rate and the internal pressure $P_1$ can be expressed by a numerical formula from Equations (5) and (6). However, strictly speaking, the value of the internal pressure $P_1$ varies slightly depending upon the conditions of production of the annular workpiece (e.g., the crystal grain size of austenite), so that it is risky to put the working pressures $P_2$ and $P_1$ into a program for an actual operation based on speculated relations. In this connection, the following automatic control is considered to be effective.

With the arrangement of FIGS. 1 and 2, if the counter force $F_1$ is excessively large as compared with the force $F_2$, the end face of the annular workpiece 1 and the presser plates are held in direct presser engagement with each other. Therefore, bruises and impressions are formed on the sliding surfaces as a result of relative sliding movements of the annular workpiece 1 and the presser plates 5, and it becomes difficult to have uniform plastic diameter enlargement in the axially middle and end portions of the workpiece 1 due to the increased sliding resistance. Consequently, it is necessary to hold the contacting pressure of the contacting surfaces of the packing 3 and the presser plates 5 in a predetermined range and to avoid interference between the annular workpiece 1 and the presser plates 5, by satisfying the following condition.

$$F_2 < F_1 \leqq F_2 + R$$

wherein
R: pressure of the contacting surfaces of the packing material and the presser plates and $$R = P_a \cdot \frac{\pi}{4}(d_{so}^2 - d_{si}^2)$$

wherein
Pa: an arbitrary preset value (kg/mm$^2$) to be applied to actual operation, varying depending upon the main pressure, etc.
$d_{so}$: outer diameter of the packing 3.
$d_{si}$: inner diameter of the packing 3.

Further, since $$F_2 = A_2 \cdot P_2$$

$$F_1 = A_1 \cdot P_1$$

the following equation is established in the relation of $F_1 = F_2 + R$.

$$P_1 = \frac{A_2}{A_1} \cdot P_2 + \frac{R}{A_1} \quad (8)$$

Figure 5:
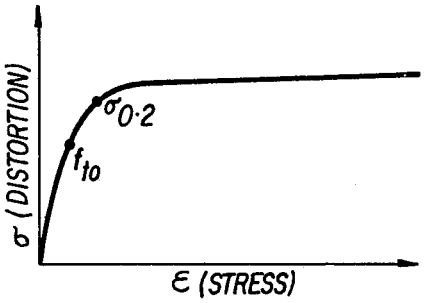
FIG. 5 is a stress-distortion diagram.

As the working according to the present invention is in the plastic range, a slight pressure increase causes a conspicuous increase of distortion as seen in FIG. 5 which illustrates the relation between the pressure (stress) and the distortion. More particularly, the control of the pressure $P_1$ is relatively easy in the range of elastic deformation where the relation between the pressure and deformation varies linearly but in the range of plastic deformation the diametric enlargement of the annular workpiece 1 is abruptly accelerated as compared with the increases of $P_2$, and as a result abruptly increasing $F_2(=A_2 \cdot P_2)$. Therefore, the counter force $F_1$ opposing the axial force $F_2$ has to be varied on a curve corresponding to the axial force $F_2$ according to the relation of Equation (8). Namely, it becomes necessary to detect the deformation of the annular workpiece 1 for the control of the auxiliary pressure $P_1$.

Now, considering the variations in the sectional area $A_2$ of the main pressure chamber $V_2$, we obtain from FIG. 2

$$A_2 = \frac{\pi}{4}(d_{so}^2 - D^2) \quad (9)$$

in which $d_{so}$ is the outer diameter of the packing 3 as mentioned hereinbefore and obtained from the corresponding information of the reductions in the wall thickness $$t = \frac{d_o - d_i}{2}$$

resulting from the diametric enlargement of the annular workpiece 1, and where D is the diameter of the center shaft 6.

Further, letting the distance between the outer diameter $d_o$ of the annular workpiece 1 and the outer diameter $d_{so}$ of the packing 3 be S, we have $$d_{so}=d_o-2\cdot S \tag{10}$$

Here, if S which is considered to be part of the wall thickness measures $S_o$ before the working, the following equation is established similarly to Equation (3).

$$S = S_o(1-\alpha)\left(1+\frac{\alpha}{2}\right) \tag{11}$$

Consequently, the information $d_{so}$ which is necessary for calculating the sectional area $A_2$ of the main pressure chamber $V_2$ can be obtained from the variations in the outer diameter of the annular workpiece 1.

The foregoing description is directed to an arrangement which obtains the value of the auxiliary pressure $P_1$ from the variations in the outer diameter and the main pressure $P_2$ as derived by Equations 8, 10 and 11. However, conversely, it is also possible to calculate the $(P_2+\Delta P_2)\cdot(A_2+\Delta A_2)$ allowed by an increment $\Delta P_1$ in the auxiliary pressure $P_1$, the sectional area $A_1$ of the auxiliary pressure chamber $V_1$, current $P_2$ and $A_2$ of the main pressure chamber $V_2$, while increasing $P_2$ and controlling the feed of the pressure medium for $P_2$ in a manner to satisfy the above-mentioned conditions. Given below is an embodiment which is directed to the control of the former case.

Figure 6:
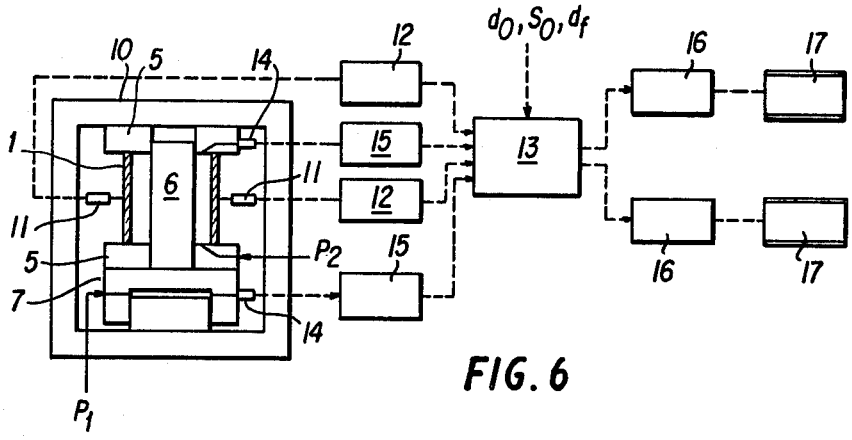
FIG. 6 is an electric circuit diagram.

Referring to FIG. 6, there is shown a block diagram of an electrical circuit which produces signals for controlling liquid pressure in the continuous cold working of an annular workpiece 1 according to variations in the shape of the material undergoing diametric enlargement.

Figure 7:
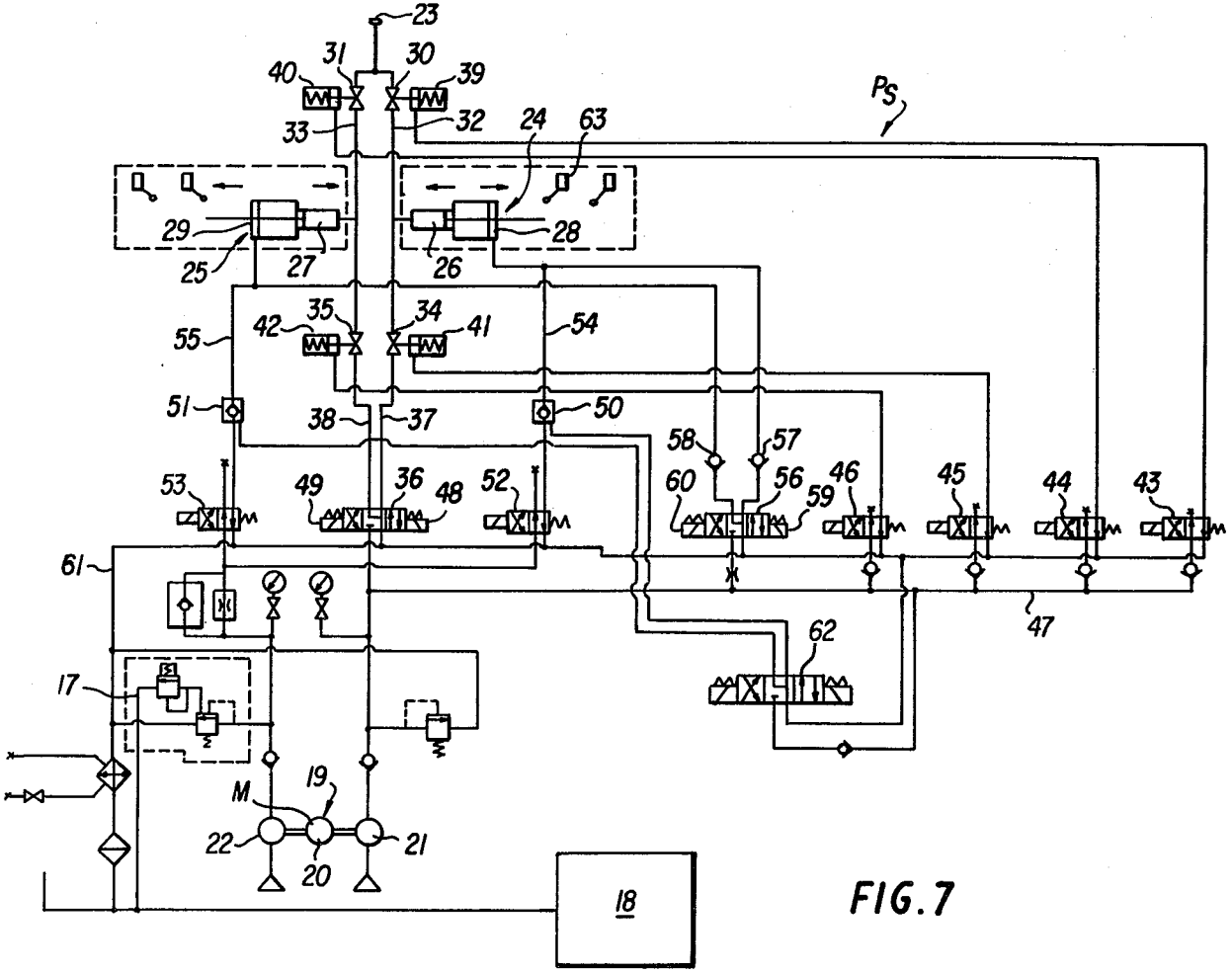
FIG. 7 is a hydraulic circuit diagram of a pressure source.

FIG. 7 illustrates an auxiliary pressure source $P_s$ which generates an auxiliary pressure $P_1$ in response to the control signals produced by the electrical circuit of FIG. 6. Although not shown, a main pressure source is arranged similarly to the auxiliary pressure source $P_s$ to produce the main pressure $P_2$ in response to the control signals produced by the electric circuit. The arrangement common to the main and auxiliary pressure sources $P_a$ and $P_s$ is described more particularly hereinafter.

Referring to FIG. 6, indicated at 11 are displacement detectors which detect displacement of the outer diameter of the annular workpiece 1 during the cold working operation and are located in radially opposed positions around the outer periphery of the annular workpiece 1. As a displacement detector 11, there may be employed a differential transformer or a potentiometer. The displacement detector 11 indirectly detects the sectional area $A_2$ of the main pressure chamber $V_2$, for example, through detection of variations in the circumference of the annular workpiece 1 or in its axial dimension or wall thickness.

Reference numeral 12 indicates converters which convert the output of the displacement detectors 11 into voltage signals suitable for application to an arithmetic unit 13. Denoted at 14 are pressure detectors which detect the auxiliary and main pressures $P_1$ and $P_2$, respectively, transmitting the respective output signals to the arithmetic unit 13 through converters 15.

The arithmetic unit 13 calculates the auxiliary and main pressures $P_1$ and $P_2$ which are necessary for cold-working the annular workpiece 1, on the basis of the outputs of converters 12 and 15, and the preset values for the outer diameters of the annular workpiece 1 and the packing 3 before and after the cold working operation ($d_o$, $S_o$ and $d_f$), producing output signals for the control of the auxiliary and main pressures $P_1$ and $P_2$.

Amplifiers designated at 16 respectively amplify the control signals for the auxiliary and main pressures $P_1$ and $P_2$ into voltage or current signals suitable for driving electromagnetic pressure control valves 17. The electromagnetic pressure control valves 17 which control the relief valves of hydraulic pumps of the respective pressure sources $P_a$ and $P_s$ in response to the received input signals may be electromagnetic relief valves or servo-valves.

When a predetermined condition is satisfied, the arithmetic circuit 13 performs the calculations which will be shown hereinafter, obtaining a preset value of the auxiliary pressure $P_1$ and increasing or reducing the auxiliary pressure control signal according to the deviation from the auxiliary pressure $P_1$ as detected by the detector 14. In a case where the deviation is increased again over a predetermined value, the auxiliary pressure control signal is increased or reduced thereby to control the auxiliary pressure $P_1$.

From Equations (9) to (11), we obtain $$A=\frac{\pi}{4}\left[\left\{d_o+\Delta d-2S_o\left(1-\frac{\Delta d}{d_o+\Delta d}\right)\left(1+\frac{\Delta d}{2(d_o+\Delta d)}\right)\right\}^2-D^2\right] \tag{12}$$

wherein $\Delta d$ = the variation in the outer diameter of the annular workpiece.

The condition for calculating the setting value of the auxiliary pressure $P_1$ by Equations (12) and (8) is either that the main pressure $P_2$ is increased to such a level as to reduce to zero the contacting surface pressure R of the packing 3 or that the main pressure $P_2$ is increased for a time in excess of a predetermined time period.

The former condition is satisfied mainly in a case where the annular workpiece 1 is undergoing elastic deformation, namely in a case where the main pressure $P_2$ is increased at a high rate against a small deformation of the annular workpiece 1, while the latter is satisfied mainly in a case wherein the annular workpiece 1 is undergoing plastic deformation, namely, where the main pressure $P_2$ is increased at a low rate against a large deformation of the annular workpiece 1.

The arithmetic unit 13 can control the increases of the main and auxiliary pressures $P_2$ and $P_1$ by either one of the following two systems. One system is to increase the main pressure $P_2$ stepwide and alternately with the auxiliary pressure $P_1$ and another is to control the increase of the main pressure $P_2$ at a constant speed while letting the auxiliary pressure $P_1$ follow it. When the initiation of plastic deformation of the annular workpiece 1 is confirmed by the extent of its deformation, the main pressure $P_2$ is increased by smaller steps in the first system and it is increased at a lower rate in the second system.

As the cold working of the annular workpiece 1 proceeds and its outer diameter exceeds the preset value $d_f$, the working is terminated by reducing the auxiliary and main pressures $P_1$ and $P_2$. Where the elastic deformation of the annular workpiece 1 at the time of pressure reduction is ignorable, the auxiliary pressure $P_1$ is reduced according to the result of calculations given by Equation (8), regarding the sectional area $A_2$ of the main pressure chamber $V_2$ as being constant. When the deformation of the annular workpiece 1 at the time of pressure reduction is unignorably large, the variations in the outer diameter of the annular workpiece 1 are detected to reduce the pressure according to the results of calculations given by Equations (8) and (12). On the other hand, the reduction of the main pressure $P_2$ is controlled by the arithmetic unit 13 to be such a rate as will adequately permit the reduction of the auxiliary pressure $P_1$.

Turning now to the pressure source $P_s$ shown in FIG. 7, indicated at 18 is an oil tank, and at 19 a pressurized oil feed section which includes a low pressure pump 21 and a high pressure pump 22 driven by a motor 20. Designated at 23 is a delivery end which communicates with the auxiliary pressure chamber $V_1$, and at 24 and 25 are first and second boosters which are provided with pistons (not shown) slidable between high pressure chambers 26 and 27 and low pressure chambers 28 and 29, respectively. The high pressure chambers 26 and 27 of the boosters 24 and 25 are communicated with the pressure delivering terminal 23 through delivery conduit 32 and 33 with stop valves 30 and 31, respectively, and with the low pressure pump 21 through high pressure conduits 37 and 38 including stop valves 34 and 35 and a change-over valve 36. The stop valves 30, 31, 34 and 35 are respectively provided with spring-loaded cylinders 39, 40, 41 and 42 for opening and closing operations, which are controlled by switching pilot valves 43 and 46, respectively. The pilot valves 43 and 46 are electromagnetic valves which are connected between the low pressure pump 21 and the change-over valve 36 through conduit 47. The change-over valve 36 is constituted by an electromagnetic valve which has two solenoid portions 48 and 49. The low pressure chambers 28 and 29 of the boosters 24 and 25 are connected to the high pressure pump 22 through low pressure conduits 54 and 55 with piloted check valves 50 and 51 and switch valves 52 and 53, respectively.

Figure 4:
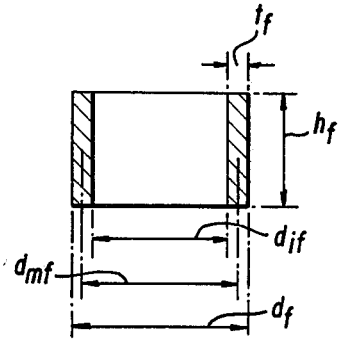

Indicated at 56 is a change-over valve for pressure reduction, which is connected to the conduit 47 branched between the low pressure pump 21 and the change-over valve 36, and to the low pressure chambers 28 and 29 of the boosters 24 and 25 through check valves 57 and 58. The change-over valve 56 is also constituted by an electromagnetic valve with two solenoid portions 59 and 60. The valves 36, 52, 53 and 56 are connected with the oil tank 18 through a return circuit 61. The reference numeral 17 denotes the electromagnetic pressure control valve of FIG. 4, which is inserted to connect a low pressure conduit between the high pressure pump 22 and the low pressure change-over valves 52 and 53 with the return circuit 61. The pressure control valve 17 is continuously remote-controllable in proportion to the output of the booster 16. Indicated at 62 is a pilot electromagnetic valve which is connected with the check valves 50 and 51.

In operation, if a low pressure feed command is present, the pilot valves 43 and 45 are excited to open the respective stop valves 30 and 34. Meanwhile, the high pressure change-over valve 36 is actuated to supply the working oil from the low pressure pump 21 to the low pressure chamber 26 of the first booster 24 and the pressure delivering terminal 23. At this time, the working oil in the low pressure chamber 28 is returned to the oil tank 18 from the return circuit 61 through the check valve 50 and low pressure change-over valve 52.

In a similar manner, the energization of the pilot valves 44 and 46 supplies low pressure working oil to the low pressure chamber 27 of the second booster 25 and the pressure delivering terminal 23. At this time, the pilot valves 43 and 45 are deenergised to close the stop valves 30 and 34, stopping the piston of the first booster 24 in a retracted position (in the direction indicated by the broken line arrow in FIG. 7). The piston of the second booster 25 is also stopped in a retracted position, upon reaching the retracted position.

In the presence of a command for pressurization, the pilot valve 43 is energised to open the stop valve 30 and the low pressure change-over valve 52 is energised to supply the working oil from the high pressure pump 22 to the low pressure chamber 28 of the first booster 24, moving its piston in a forward direction (in the direction indicated by the solid line arrow in FIG. 7). At this time, since the stop valve 30 is opened and the stop valves 31 and 34 are in a closed state, the working oil in the high pressure chamber 26 of the first booster 24 is pressurized by the forward movement of the piston, increasing the pressure in the pressure delivering conduit 33.

Next, as soon as a limit switch which limits the forward movement of the first booster 24 is actuated to start a timer, the piston of the second booster 25 is also moved in the forward direction similarly to the first booster 24 while the latter is held in the pressurized state.

Upon a lapse of a predetermined time set in the timer, the pilot valve 43 is de-energsed to close the stop valve 30, increasing the pressure in the pressure delivering conduit 33 by the pressurization on the side of the second booster 25 and thus supplying a high pressure to the delivering terminal 23. Meanwhile the stop valve 34 is opened to supply the working oil from the low pressure pump 21 to the high pressure chamber 26 of the first booster 24 through the high pressure change-over valve 36, and the working oil in the low pressure chamber 28 is returned to the oil tank 18 through the return circuit 61, moving the piston of the first booster 24 back to the retracted position. The same operations are repeated to increse the circuit pressure stepwise until a super-high level is attained.

During the pressurizing process, the opening of the pressure control valve 17 can be controlled by the amplifier 16 to obtain arbitrary characteristics of pressurization according to the degree of the opening. Upon producing a command signal for pressure reduction, the pressure is reduced continuously by operating the pilot electromagnetic valve 62, check valves 50 and 51, and pressure reducing change-over valve 56 in a manner substantially reverse to the operation ofr super-high pressurization.

For draining the pressure, the pilot valves 43 and 45 are energised to open the stop valves 30 and 34 thereby returning the working oil at the delivery terminal 23 to the oil tank 18 from the return circuit 61 through the stop valves 30 and 34 and high pressure change-over valve 36.

The method and apparatus according to the present invention were experimentally applied to cold working of annular workpieces of practical sizes. The results are shown in Table 1 with regard to differences between dimensions before and after the working operation.

TABLE 1

| | Dimensions of Sample Annular Workpieces | | | | |
|---|---|---|---|---|---|
| | General dimensions (mm) | | | | |
| | Outer diam. $d_o$ | Inner diam. $d_i$ | Height h. | Average diam. $d_m$ | Average working rate $\alpha m$ (%) |
| Before working | 770 | 610 | 610 | 690 | — |
| After working | 853 | 702 | 575 | 777.5 | — |
| | 83 | 92 | −35 | 87.5 | 11.25 |

As seen in Table 1, the annular workpiece 1 is enlarged by about 92 mm in inner diameter ($d_i$) and about 83 mm in outer diameter ($d_o$), with a working rate of $\alpha=11.25$ and a reduction in height of about 35 mm.

Tables 2 and 3 below show irregularities in dimensions with regard to the degree of oval deformation and the degree of bulge deformation occurring at the same working rate.

TABLE 2

| | Irregularities in dimensions (degree of oval deformation), values of $d_{max}$, $-d_{min}$ | | |
|---|---|---|---|
| | Axial measuring positions | | |
| | (1) | (2) | (3) |
| Outer diam. (mm) | 0.47 | 0.45 | 0.40 |
| Inner diam. (mm) | 0.57 | 0.57 | 0.62 |

TABLE 3

| | Irregularities in dimensions (degree of bulge deformation) | | | |
|---|---|---|---|---|
| | Circumferential measuring positions | | | |
| | a–e | b–f | c–f | d–f |
| Outer diam. (mm) | 2.01 | 1.92 | 1.77 | 1.99 |
| Inner diam. | 2.18 | 2.16 | 1.97 | 2.18 |

Figure 8:
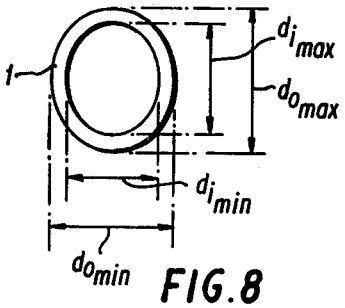
FIGS. 8 to 11 are diagrammatic views showing the results of cold working operations.
Figure 9:
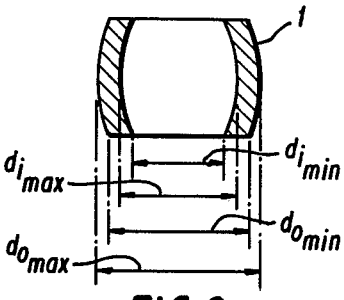
Figure 11:
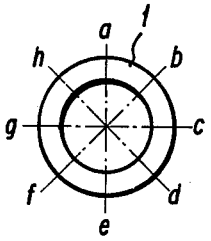
Figure 10:
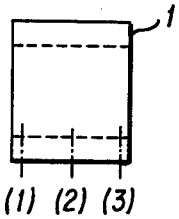

In this connection, it is to be noted that Table 2 corresponds to FIG. 8 and the measuring positions of Table 2 corresponds to the positions of the same reference numerals in FIG. 10. Further, Table 3 corresponds to FIG. 9 and the measuring positions of Table 3 corresponds to the positions of the same reference numerals in FIG. 11.

As seen in these tables, dimensionally there is almost no problem in the degree of ovalness (close to a true circle). The dimensional errors predominate in the degree of bulge deformation are only about 2% of the total working dimensional change which is industrially an ignorable value and rather reveals the superiority of the method of the invention. The measurement of residual stress in the respective sample material showed a value of 1.14 to 1.42, proving their excellent quality.

According to the present invention, the packing 3 which hermetically seals the main pressure chanber $V_2$ is slid along the surface of the presser plate 5 through deformation thereof to follow the diametric enlargement of the annular workpiece 1, taking a drastic departure in concept from the conventional method using tapered cones for sealing. More particularly, the pressure for sealing the main pressure chamber $V_2$ is born by the packing 3 so as to free the annular workpiece 1 of the wedge actions as imposed by the conventional sealing cones, thereby ensuring uniform working and quality of the annular workpiece 1. Further, since the packing 3 and presser plate 5 are held in pressed engagement with each other by surfaces perpendicular to the longitudinal axis of the annular workpiece, the axial movement of the presser plate 5 is able to follow the reductions in the axial length of the annular workpiece resulting from its dimetric enlargement. Therefore, it becomes possible to shorten the stroke length of the presser plate 5 considerably as compared with the conventional cone seal devices and, due to the shorter stroke length, to use a higher oil pressure for a cylinder of a given strength (as the bulge elastic deformation of the cylinder becomes greater with a large stroke length). As a result, the design of the auxiliary pressure chamber $V_1$ is facilitated and the entire equipment can be provided in a compact form, a departure from the large forging press.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for cold working an annular workpiece by applying thereto an internal fluid pressure to cause diametric enlargement of said workpiece through plastic deformation, said method comprising:

forming annular grooves around marginal edges of openings at axially opposite ends of said annular workpiece fitting a packing of ring form in each one of said annular grooves; and covering each of said openings with a presser plate and holding said presser plates in slidably pressed contact with said packings during the process of diametric enlargement of said annular workpiece and said packing by application of an increasing internal pressure, including the step of maintaining the contacting surface pressure of said packings and pressure plates at a predetermined value by detecting and calculating values indicative of a main pressure internally acting on said annular workpiece an auxiliary pressure pressing said presser plate against said packing and variations in the shape of said annular workpiece resulting from the increase of said main pressure thereby continuously working said annular workpiece by plastic deformation.

2. An apparatus for cold working an annular workpiece having an internal cavity by applying thereto an internal fluid pressure to cause diametric enlargement of said annular workpiece through plastic deformation, said apparatus comprising:

a pair of diametrically expansible packings of ring form, one of said packings to be fitted in an annular groove formed in an opening at each axially opposite end of said annular workpiece a pair of presser plates, each said presser plate covering one said opening of said annular workpiece and adapted to be held in radially slidable pressed contact with one of said packings a main pressure source connected to a main pressure chamber defined by said internal cavity of said annular workpiece;

a cylinder device operable for moving said presser plate axially of said annular workpiece, said cylinder device internally defining an auxiliary pressure chamber and an auxiliary pressure source connected to said auxiliary pressure chamber, further comprising an arithmetic unit connected to said main auxiliary pressure sources and adapted to maintain the contacting surface pressure of each said packing and presser plate at a predetermined value by detecting and calculating values indicative of a main pressure acting in said main pressure chamber, an auxiliary pressure acting in said auxiliary pressure chamber and variations in the shape of said annular workpiece.

* * * * *

UNITED STATES PATENT AND TRADEMARK OFFICE

CERTIFICATE OF CORRECTION

PATENT NO. : 4,364,251

DATED : December 21, 1982

INVENTOR(S) : MASAO NISHIHARA ET AL

It is certified that error appears in the above-identified patent and that said Letters Patent is hereby corrected as shown below:

In the Abstract, second and third line from bottom, delete "varitions" and insert therfor --variations--;

Column 1, line 64, delete "trucated" and insert therefor --truncated--;

Column 2, line 65, delete "diametrally" and insert therefor --diametrically--;

Column 3, line 6, after "operable" delete "or" and insert therefor --for--;

Column 4, line 32, after "by use" insert --of--;

UNITED STATES PATENT AND TRADEMARK OFFICE

CERTIFICATE OF CORRECTION

PATENT NO. : 4,364,251 Page 2 of 2

DATED : December 21, 1982

INVENTOR(S) : MASAO NISHIHARA ET AL

It is certified that error appears in the above-identified patent and that said Letters Patent is hereby corrected as shown below:

Column 8, line 29, at the beginning of equation, delete "A =", and insert therefor --$A_2$ = --;

Column 10, line 34, delete "de-energsed" and insert therefor --deenergised--;

Column 10, line 56, delete "ofr" and insert therefor --for--;

Column 11, line 60, delete "chanber" and insert therefor --chamber--;

Column 12, line 8, delete "dimetric" and insert therefor --diametric--.

Signed and Sealed this

*Fifth* Day of *April 1983*

[SEAL]

*Attest:*

GERALD J. MOSSINGHOFF

*Attesting Officer* *Commissioner of Patents and Trademarks*

UNITED STATES PATENT AND TRADEMARK OFFICE

CERTIFICATE OF CORRECTION

PATENT NO. : 4,364,251

DATED : 12-21-82

INVENTOR(S) : Masao Nishihara et al

It is certified that error appears in the above-identified patent and that said Letters Patent is hereby corrected as shown below:

On the title page, Item (75) Inventors' should read:

-- Masao Nishihara, Kyoto; Yoshinori Fukui; Yoshio Kitamura, both of Hyogo; Yoshiyuki Kamikawa; Haruki Azuma, both of Kobe; Shigeo Hattori, Kobe; Masakatsu Kawahara; Hyogo; and Masaru Takeda; Kobe, all of Japan --.

Signed and Sealed this

*Thirtieth* Day of *August 1983*

[SEAL]

*Attest:*

GERALD J. MOSSINGHOFF

*Attesting Officer*

*Commissioner of Patents and Trademarks*